US009945627B2

(12) United States Patent
Porat

(10) Patent No.: US 9,945,627 B2
(45) Date of Patent: Apr. 17, 2018

(54) MAGAZINE ATTACHMENT

(71) Applicant: Recover Innovations Ltd., Holon (IL)

(72) Inventor: Tamir Porat, Tel Aviv (IL)

(73) Assignee: Recover Innovations Ltd., Holon (IL)

( * ) Notice: Subject to any disclaimer, the term of this patent is extended or adjusted under 35 U.S.C. 154(b) by 0 days.

(21) Appl. No.: 15/386,109

(22) Filed: Dec. 21, 2016

(65) Prior Publication Data

US 2017/0184359 A1 Jun. 29, 2017

Related U.S. Application Data

(60) Provisional application No. 62/272,155, filed on Dec. 29, 2015.

(51) Int. Cl.

| | |
|---|---|
| ***F41A 35/00*** | (2006.01) |
| ***F41C 27/00*** | (2006.01) |
| ***F41A 9/65*** | (2006.01) |

(52) U.S. Cl.

CPC ..... *F41A 9/65* (2013.01)

(58) Field of Classification Search

CPC .... F41A 35/00; F41A 9/65; F41A 9/68; F41A 17/38; F41C 23/10; F41C 23/22; F41C 23/12; F41C 27/00

See application file for complete search history.

(56) References Cited

U.S. PATENT DOCUMENTS

| | | | | | |
|---|---|---|---|---|---|
| 4,348,716 | A * | 9/1982 | Storm | F41G 1/35 | 362/110 |
| 4,495,720 | A * | 1/1985 | Bross | F41A 9/65 | 42/7 |
| 4,520,585 | A * | 6/1985 | Barrett | F41C 23/10 | 42/7 |
| 4,570,370 | A * | 2/1986 | Smith | F41C 23/10 | 42/7 |
| 4,592,160 | A * | 6/1986 | Bross | F41A 9/65 | 42/7 |
| 4,862,619 | A * | 9/1989 | Baldus | F41A 9/71 | 42/7 |
| 5,437,118 | A * | 8/1995 | Sniezak | F41C 23/10 | 42/7 |
| 5,628,555 | A * | 5/1997 | Sharrah | F41G 1/34 | 362/114 |
| 5,816,683 | A * | 10/1998 | Christiansen | F41C 27/00 | 362/110 |
| 6,023,875 | A * | 2/2000 | Fell | F41C 23/22 | 362/114 |
| 6,481,136 | B1 * | 11/2002 | Fitzpartick | F41A 9/65 | 42/18 |
| 7,587,852 | B1 * | 9/2009 | Harms | F41C 23/14 | 42/71.02 |
| 8,590,202 | B2 * | 11/2013 | Keng | F41A 9/65 | 42/90 |
| 8,863,423 | B2 * | 10/2014 | Clifton, Jr. | F41A 9/65 | 42/49.01 |
| 2003/0037474 | A1 * | 2/2003 | Weber | F41C 23/12 | 42/71.02 |

(Continued)

*Primary Examiner* — Derrick R Morgan

(74) *Attorney, Agent, or Firm* — Dekel Patent Ltd.; David Klein

(57) ABSTRACT

A weapon magazine accessory includes a floor plate member mountable on a bottom portion of a magazine, and a clip element which attaches to the floor plate member, the clip element including a keeper element.

8 Claims, 2 Drawing Sheets

(56) References Cited

U.S. PATENT DOCUMENTS

| | | | | |
|---|---|---|---|---|
| 2009/0235569 | A1* | 9/2009 | Morando | F41A 9/65<br>42/108 |
| 2010/0154269 | A1* | 6/2010 | Escalante | F41A 9/65<br>42/49.01 |
| 2011/0107645 | A1* | 5/2011 | Faifer | F41A 9/63<br>42/90 |
| 2012/0091173 | A1* | 4/2012 | Crye | F41A 9/65<br>224/196 |
| 2013/0019511 | A1* | 1/2013 | Plataniotis | F41A 9/65<br>42/6 |
| 2013/0139426 | A1* | 6/2013 | Baxley | F41C 23/10<br>42/71.02 |
| 2013/0205635 | A1* | 8/2013 | Hines | F41C 23/16<br>42/71.02 |
| 2013/0333261 | A1* | 12/2013 | Clifton, Jr. | F41A 9/65<br>42/50 |
| 2014/0283427 | A1* | 9/2014 | Castro | F41A 9/67<br>42/49.01 |
| 2016/0265872 | A1* | 9/2016 | Tarazi | F41C 27/22 |

* cited by examiner

MAGAZINE ATTACHMENT

FIELD OF THE INVENTION

The present invention relates generally to weapons and magazine accessories, and particularly to a magazine attachment that can be used to hang or clip the magazine to apparel and the like.

BACKGROUND OF THE INVENTION

As is well known in the art, handguns, e.g., pistols, come in a variety of manufactured sizes, e.g., some referred to as full-size, compact and sub-compact. A magazine containing rounds of ammunition is inserted in a magazine well formed in the grip of the pistol. Magazines are manufactured in different sizes in accordance with the size of the handgun as well as in accordance to the number of rounds that the magazine holds, such that the floor plate of the magazine is generally flush with the bottom of the grip. There is an industry which has been created around the provision of replacement magazine base plates. Replacement base plates can be purchased from companies such as VICKERS TACTICAL, STRIKE INDUSTRIES, and BROWNELLS that carry many types of options for replacement base plates. The available replacement baseplates focus mainly on enhancing the ergonomics of the magazine loading and reloading process. The addition of the mounting clip onto the magazine that allows the magazine to be carried in various different positions alleviates the need to carry an extra magazine pouch.

SUMMARY OF THE INVENTION

The present invention seeks to provide a magazine attachment that mounts on the bottom of the magazine and that can be used to hang or clip the magazine to apparel, Molle vests and the like without the need to purchase new pouches that add bulk. The magazine attachment may optionally be used to hold or store accessories such as a tactical light or other items, as is described more in detail hereinbelow.

There is provided in accordance with an embodiment of the invention a weapon magazine accessory including a floor plate member mountable on a bottom portion of a magazine, and a clip element which attaches to the floor plate member, the clip element including a keeper element.

In accordance with an embodiment of the invention the floor plate member includes an upper surface with a rim protruding upwards from the upper surface to define a magazine receiving portion for receiving therein the bottom portion of the magazine. The rim may or may not extend a full perimeter of the floor plate member. For example, the rim may have an open end.

In accordance with an embodiment of the invention the floor plate member replaces an existing floor plate of the magazine.

In accordance with an embodiment of the invention the floor plate member includes a receiving portion and the clip element includes a fastener that fastens with the receiving member.

In accordance with an embodiment of the invention the clip element is attached to a tactical rail element that includes an accessories rail.

There is also provided in accordance with an embodiment of the invention a firearm magazine, a weapon magazine accessory including a floor plate member mounted on a bottom portion of the magazine, and a clip element which attaches to the floor plate member, the clip element including a keeper element.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1A:
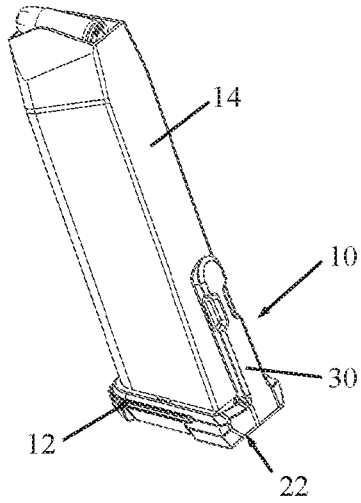
FIGS. 1A and 1B are simplified pictorial illustrations of a magazine attachment mounted on a magazine, constructed and operative in accordance with an embodiment of the present invention.
Figure 1B:
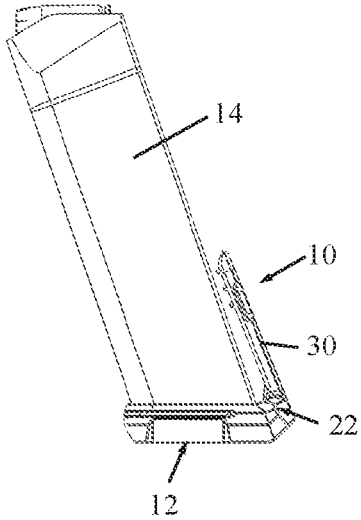

Reference is now made to FIGS. 1A-3B, which illustrate a magazine attachment (weapon magazine accessory) 10, constructed and operative in accordance with a non-limiting embodiment of the present invention.

The weapon magazine accessory 10 includes a floor plate member 12 mountable on a bottom portion of a magazine 14. The weapon magazine accessory 10 may be snugly fit onto the bottom portion of magazine 14. For example, in accordance with a non-limiting embodiment of the invention, floor plate member 12 includes an upper surface 16 with a rim 18 protruding upwards from the upper surface 16. In one option, rim 18 extends the full perimeter of floor plate member 12 to define a magazine receiving portion for receiving therein the bottom portion of magazine 14. In another option, rim 18 has an open end 20 to facilitate sliding the weapon magazine accessory 10 onto the bottom portion of magazine 14.

In one embodiment, the floor plate member 12 replaces the existing floor plate of the magazine 14. In such a case, the rim 18 is dimensioned accordingly so that the magazine receiving portion receives therein the bottom portion of magazine 14 after the original floor plate has been removed. In another embodiment, the floor plate member 12 does not replace the existing floor plate of the magazine 14, but instead rim 18 is dimensioned accordingly so that the magazine receiving portion receives therein the bottom portion of magazine 14 with the original floor plate in place.

Figure 3A:
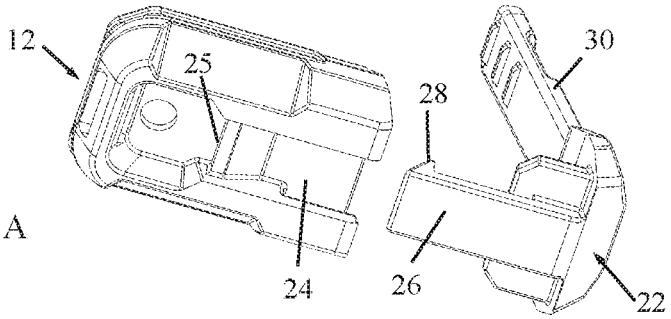
FIGS. 3A and 3B are simplified, underside pictorial illustrations of the floor plate and clip element of the magazine attachment, respectively before and after assembling together.
Figure 3B:
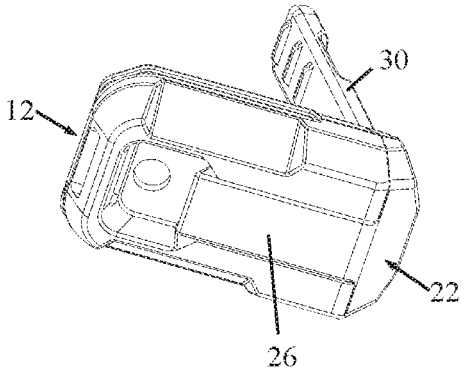

As seen in FIGS. 3A and 3B, weapon magazine accessory 10 may further include a clip element 22 which attaches to floor plate member 12. For example, floor plate member 12 may include a receiving portion 24, such as a slot 24 with an abutment 25. The clip element 22 may include a fastener 26, such as but not limited to, a tongue 26 with a claw end 28. The tongue 26 slides into slot (receiving portion) 24 and the claw end 28 snaps over the abutment 25, thereby fixing clip element 22 to floor plate member 12. The clip element 22 may include a keeper element 30, such as a cantilevered, elongate bar. The keeper element 30 may be clipped or hung on a belt of a shooter, tucked into a shirt pocket, or hung from or clipped to any other item.

The weapon magazine accessory 10 may be made of a polymer, metal, elastomer or any other suitable material.

Figure 2:
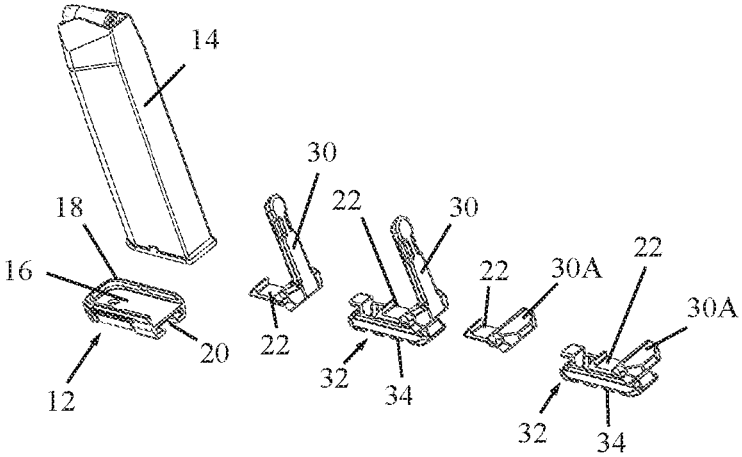
FIG. 2 is a simplified pictorial illustration of a floor plate and two different clip elements (with and without tactical rail elements) of the magazine attachment before assembling together.

Referring to FIG. 2, it is seen that instead of the elongate keeper element 30, the clip element 22 may include a stubby, short keeper element 30A depending on the particular need.

Figure 4:
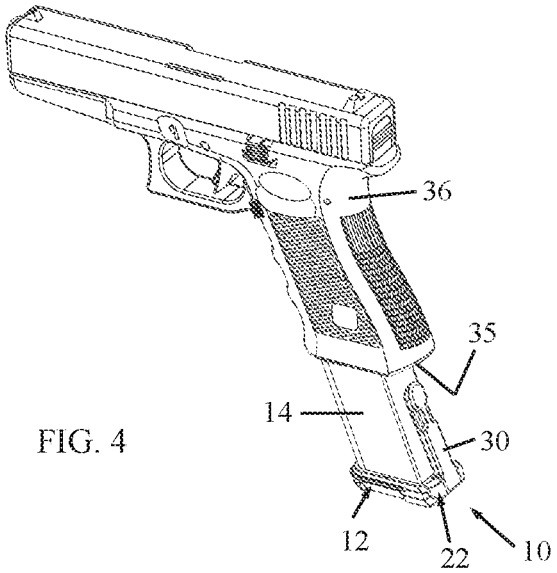
FIG. 4 is a simplified pictorial illustration of the magazine with the magazine attachment being inserted in a magazine well of a weapon.

As seen in FIG. 4, keeper element 30 is configured to fit into a hollow portion of a magazine well 35 of a weapon 36, such as but not limited to, the hollow portion of the magazine well near the backstrap on a GLOCK 17 or SMITH AND WESSON M&P. Accordingly, the user does not have to remove the weapon magazine accessory 10 from magazine 14 before inserting magazine 14 into the weapon 36.

Reference is now made again to FIG. 2, which illustrates the clip element 22 attached to a tactical rail element 32, which includes an accessories rail 34 on a lower face thereof. The accessories rail 34 may be, without limitation, a Picatinny rail or Weaver rail. It is noted that the term "light rail" (or a "Picatinny rail", or "universal rail", or "tactical rail", or "accessories rail", the terms being used interchangeably throughout the specification and claims) as used in the description and the claims, encompasses any kind of mounting rail for accessories, such as but not limited to, white lights, infrared and laser illuminating devices and telescopic sights, for example.

In one embodiment, clip element 22 and tactical rail element 32 are first attached to one another before attaching the assembly to floor plate member 12. In another embodiment, clip element 22 is first attached to floor plate member 12 and then tactical rail element 32 is attached to the assembly. In yet another embodiment, tactical rail element 32 is first attached to floor plate member 12 and then clip element 22 is attached to the assembly.

What is claimed is:

1. A weapon magazine accessory comprising:

a floor plate member mountable on a bottom portion of a magazine; and a clip element which attaches to said floor plate member, said clip element comprising a keeper element, said keeper element extending upwards from said floor plate member to be along a rear surface of said magazine; and wherein said floor plate member comprises an upper surface with a rim protruding upwards from said upper surface to define a magazine receiving portion for receiving therein the bottom portion of the magazine; and wherein said floor plate member comprises a receiving portion on a surface opposite the upper surface and said clip element comprises a fastener that slides into said receiving portion to fix said clip element to said floor plate member.

2. The weapon magazine accessory according to claim 1, wherein said receiving portion comprises a slot with an abutment and said fastener comprises a tongue with a claw end, wherein said tongue slides into said slot and said claw end snaps over said abutment.

3. The weapon magazine accessory according to claim 1, wherein said rim has an open end.

4. The weapon magazine accessory according to claim 1, wherein said floor plate member replaces an existing floor plate of the magazine.

5. The weapon magazine accessory according to claim 1, further comprising an auxiliary keeper element useable in place of said first-mentioned keeper element which is shorter in length than said first-mentioned keeper element.

6. The weapon magazine accessory according to claim 1, wherein said keeper element comprises a cantilevered, elongate bar.

7. The weapon magazine accessory according to claim 1, wherein a tactical rail element is positioned on a bottom surface of said clip element facing away from said floor plate member.

8. An apparatus comprising:

a firearm magazine;

a weapon magazine accessory comprising a floor plate member, said floor plate member comprising a magazine receiving portion on an upper surface which is configured to receive mounted on a bottom portion of said magazine; and a clip element which attaches to a bottom surface of said floor plate member, said clip element comprising a keeper element, said keeper element extending upwards from said floor plate member clip element along a rear surface of said magazine; and a tactical rail element positioned on a bottom surface of said clip element facing away from said floor plate member.

* * * * *